US007356303B2

(12) United States Patent
Mizuno et al.

(10) Patent No.: US 7,356,303 B2
(45) Date of Patent: Apr. 8, 2008

(54) IMAGE FORMING APPARATUS AND A SHEET CONVEYING METHOD OF THE IMAGE FORMING APPARATUS

(75) Inventors: Kyoichi Mizuno, Hachioji (JP); Shinichi Kawabata, Hachioji (JP); Taro Miyamoto, Hachioji (JP); Kunihiro Kawachi, Hachioji (JP); Ken Nonaka, Hachioji (JP); Kazunobu Miura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 225 days.

(21) Appl. No.: 11/114,869

(22) Filed: Apr. 26, 2005

(65) Prior Publication Data

US 2006/0056895 A1 Mar. 16, 2006

(30) Foreign Application Priority Data

Sep. 15, 2004 (JP) ..... 2004-268048
Mar. 11, 2005 (JP) ..... 2005-068593

(51) Int. Cl.
*G03G 15/00* (2006.01)
*B65H 29/70* (2006.01)
*B65H 23/34* (2006.01)

(52) U.S. Cl. ..... 399/406; 399/401; 271/188; 162/270; 162/271

(58) Field of Classification Search ..... 399/401, 399/406; 271/188, 209, 225; 162/270, 271
See application file for complete search history.

(56) References Cited

U.S. PATENT DOCUMENTS 5,515,152 A * 5/1996 Kuo ..... 399/406

FOREIGN PATENT DOCUMENTS

| | | |
|---|---|---|
| JP | 03279157 | 12/1991 |
| JP | 05-341600 | 12/1993 |
| JP | 06-115792 | 4/1994 |
| JP | 06-144677 | 5/1994 |
| JP | 07-061677 | 3/1995 |
| JP | 10194547 | 7/1998 |
| JP | 2003-302861 | 10/2003 |

* cited by examiner

*Primary Examiner*—Ren Yan
(74) *Attorney, Agent, or Firm*—Lucas & Mercanti, LLP

(57) ABSTRACT

An image forming apparatus having: an image forming portion to form an image on a sheet; a fixing device to fix the image to the sheet by heating; a conveying path switching member to switch a conveying direction of the sheet, which is provided on downstream of the fixing device in a sheet conveying direction; a first conveying path which has a first curved portion and is provided on downstream of the conveying path switching member; a second conveying path which has a second curved portion and is provided on downstream of the conveying path switching member; a curl applying member which is provided on downstream of the fixing device, and on upstream of the first and second curved portions; and a control unit to control driving of the conveying path switching member and of the curl applying member.

4 Claims, 5 Drawing Sheets

IMAGE FORMING APPARATUS AND A SHEET CONVEYING METHOD OF THE IMAGE FORMING APPARATUS

BACKGROUND OF THE INVENTION

1. Field of the Invention

The present invention relates to an image forming apparatus comprising a structure to prevent a sheet fixed by a fixing device of the image forming apparatus for forming an image by an electrophotographic system from curling, and a sheet conveying method of the image forming apparatus.

2. Description of the Related Art

Conventionally, in the electrophotographic system, a heating and fixing device of a contact heating type in which a toner image on a paper is heated and pressurized to be fixed has been broadly used. Further, a heating and fixing device in which a toner image is heated and fixed while sandwiching and conveying a paper by a fixing roller and a pressure roller has been most widely used.

In the case of heating a paper to fix an image, the paper becomes soft, so that paper deformation, especially curl of the paper easily occurs. Thus, there is a problem that the curl of the paper occurs after passing the heating and fixing device, and in a subsequent conveying path. When the curled paper is conveyed on the conveying path provided on the downstream of the fixing device, problems occur such as that jamming occurs or that papers are not aligned on an eject tray.

As a method to solve the occurrence of the curl of the papers due to such heating and fixing device, there is disclosed a technique in which the curl of the paper which was fixed is corrected by using a conveying belt and a pressure roller (JP-Tokukaihei-5-341600 and JP-Tokukaihei-6-144677, hereinafter refer to "Patent Document 1" and "Patent Document 2", respectively). Moreover, there is disclosed a technique in which a curl removing member to curve the paper by contacting the surface of the paper which was fixed is provided, and thereby removing the curl which was generated due to the fixing (JP-Tokukaihei-6-115792, hereinafter refer to "Patent Document 3"). Further, there is disclosed a technique in which an upper side sheet path and a lower side paper path are provided on the downstream side of the fixing device, thereby removing the curl in any direction which was generated due to the fixing by switching the paths with the use of a guide member (JP-Tokukaihei-7-61677, hereinafter refer to "Patent Document 4"). Further, there is disclosed a technique in which the curl of the paper is reduced by the combination of controlled surface temperatures of the fixing roller and the pressure roller (JP-Tokukai-2003-302861, hereinafter refer to "Patent Document 5"). The above described techniques of the Patent Documents 1-5 have a technical idea of removing the curl of the paper by correcting the curl generated due to the heating and fixing device.

However, according to the studies by the inventors, the phenomenon has been found out that the final curl of the paper is determined due to the shape of the conveying path provided on the downstream side of the fixing device as well as the curl generated by the fixing device. That is, the paper becomes soft due to the heat by the fixing device to be easily deformed, and the final curl of the paper is determined after it was cooled to some extent. Accordingly, in the case where the conveying path on the downstream side of the fixing device is linearly formed, the curl generated due to the fixing device may be removed. However, in the case where the conveying path on the downstream side of the fixing device is curved, the curl corresponding to the curved shape is further generated. That is, the paper is cooled while being conveyed on the curved shaped conveying path, so that another curl which is different from the curl generated due to the fixing device is generated due to the curved shaped conveying path. The final curl of the paper is considered as the curl due mainly to the curved shaped conveying path.

SUMMARY OF THE INVENTION

The present invention is developed in view of the above described problems, and an object of the present invention is to provide an ink jet printer capable of precisely detecting remaining ink amount in a main tank without raising cost.

For solving the problems, in accordance with the first aspect of the present invention, the image forming apparatus comprises:

an image forming portion to form a transferred toner image on a sheet;

a fixing device to fix the formed transferred toner image to the sheet by heating;

a conveying path switching member to switch a conveying direction of the sheet, the conveying path switching member being provided on a downstream side of the fixing device in a sheet conveying direction;

a first conveying path having a first curved portion, the first conveying path being provided on a downstream side of the conveying path switching member in the sheet conveying direction;

a second conveying path having a second curved portion, the second conveying path being provided on a downstream side of the conveying path switching member in the sheet conveying direction;

a curl applying member which is provided on a downstream side of the fixing device in the sheet conveying direction, and on an upstream side of the first curved portion and the second curved portion in the sheet conveying direction; and a control unit to control a driving of the conveying path switching member and of the curl applying member.

According to the first aspect of the present invention, the curl in the opposite direction of the direction of the curl which is generated in the curved conveying path is previously applied, so that the curl generated in the curved conveying path and the previously applied curl are compensated each other. Thus, the curl can be removed, and stably conveying the paper can be achieved.

Further, the conveying path switching member may be used as the curl applying member.

Further, the control unit may perform a control to make the curl applying member contact the sheet which is being conveyed.

Further, a bent conveying path may be formed by making the curl applying member contact the sheet.

Further, a bending direction of the bent conveying path may be an opposite direction to a curving direction of the first curved portion or the second curved portion.

Further, the image forming apparatus may further comprise a pair of guide members which face the curl applying member, wherein the bent conveying path may be formed with the curl applying member and one of the pair of guide members.

Further, the first conveying path may be provided with a first conveying roller, the second conveying path may be provided with a second conveying roller, and the control unit may perform a control to make the curl applying member contact the sheet at the timing after an end of the sheet was sandwiched by the first conveying roller or the second conveying roller.

In accordance with the second aspect of the present invention, the sheet conveying method in an image forming apparatus comprises:

forming a transferred toner image on a sheet at an image forming portion;

fixing the transferred toner image to the sheet by heating;

conveying the sheet after the fixing to a conveying path having a curved portion; and applying a curl to curve the sheet in an opposite direction to a curving direction of the curved portion, at an upstream side of the curved portion in a sheet conveying direction.

According to the second aspect of the present invention, the curl in the opposite direction of the direction of the curl which is generated in the curved conveying path is previously applied, so that the curl generated in the curved conveying path and the previously applied curl are compensated each other. Thus, the curl can be removed, and stably conveying the paper can be achieved.

Further, the applying a curl may be performed by forming a bent conveying path.

Further, the applying a curl may be performed by making a conveying path switching member to switch a conveying direction of the sheet contact the sheet, the conveying path switching member being provided on a downstream side of a fixing device to fix the transferred toner image to the sheet, in the sheet conveying direction.

Further, the conveying path having the curved portion may be a first conveying path having a first curved portion and a second conveying path having a second curved portion, and the first curved portion and the second curved portion may curve in an opposite direction with each other.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENTS

The embodiment according to the present invention will be explained based on the drawings.

Figure 1:
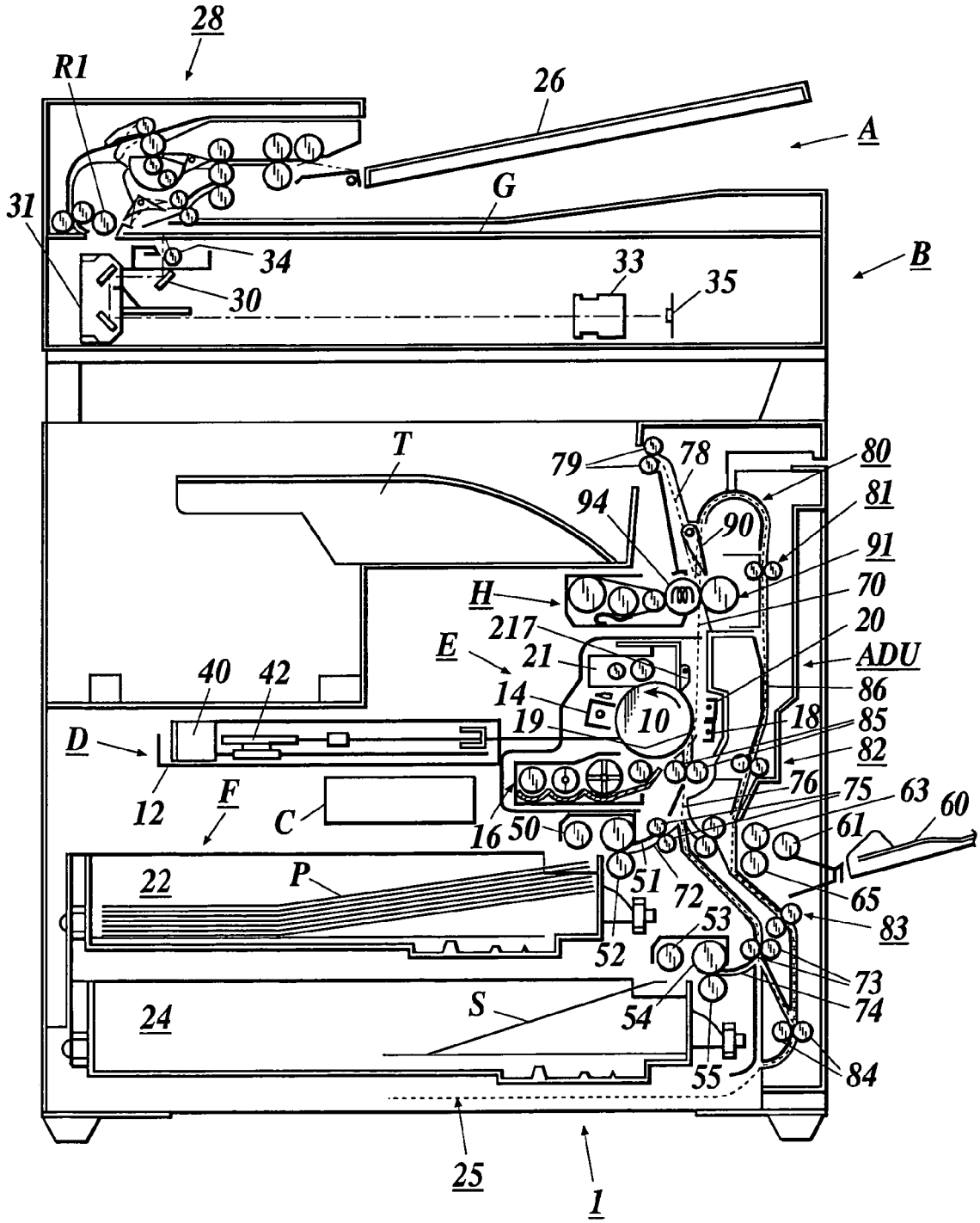
FIG. 1 is a view showing a whole structure of an image forming apparatus of the embodiment according to the present invention.
Figure 2:
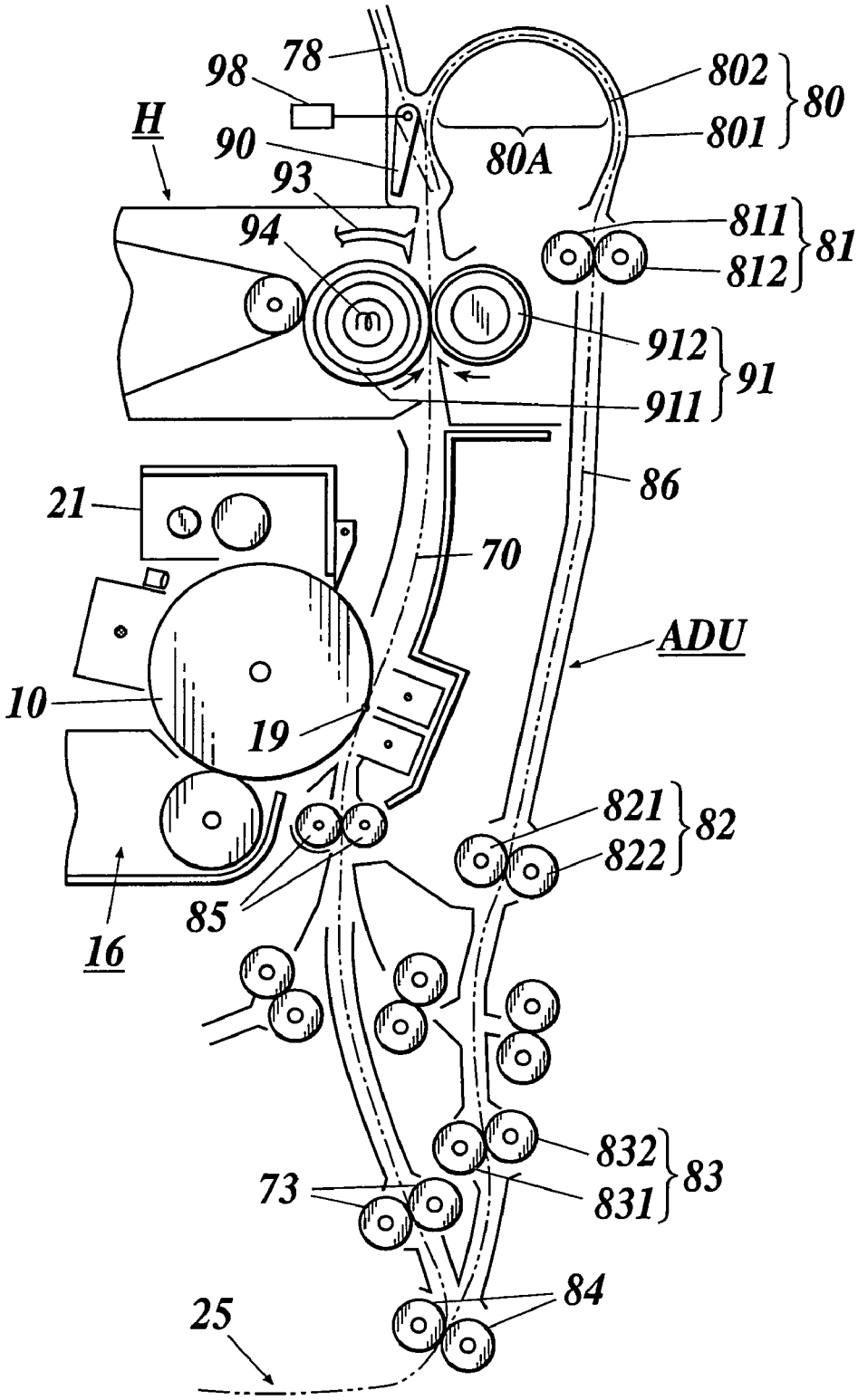
FIG. 2 is a structural view showing a reverse feeding mechanism of the image forming apparatus of the embodiment according to the present invention.

FIG. 1 is a view showing a whole structure of an image forming apparatus of the embodiment according to the present invention, and FIG. 2 is a structural view showing a reverse feeding mechanism of the image forming apparatus of the embodiment according to the present invention.

In FIG. 1, an image forming apparatus 1 comprises an automatic document conveying device A, a document image reading portion B, an image processing portion C to process the document image which was read, a writing portion D including a writing unit, an image forming portion E including a transfer portion 19, a fixing device H, a storing portion F to store papers P on which images are to be formed, a reverse feeding mechanism ADU to reverse and convey a paper to re-feed the paper, and the like.

The automatic document conveying device A comprises an input tray 26, and a document conveying portion 28 having a roller group including a roller R1 and a switching guide for switching a conveying path of a document.

The document image reading portion B is a reading portion to read the image on the document which was conveyed by the automatic document conveying device A, and is arranged under a platen glass G. The document image reading portion B comprises an exposure lamp 34, two mirror units 30 and 31 which can reciprocate while maintaining light path length, an fixed imaging lens 33, a linear image sensor 35 and the like.

The image processing portion C is an image processing portion to perform image processing of the image on the document which was read.

The writing portion D comprises the writing unit 12 having a laser light source 40, a polygon mirror 42 and the like, and writes the image data on a photosensitive body 10 according to the image data after the image processing.

The image forming portion E is an image forming portion of electrophotographic system having a charging electrode 14, a developing machine 16, a transferring electrode 18, a separating electrode 20, a cleaning section 21 and the like around the photosensitive body 10 and therearound. Viewed from the conveying direction of the paper P, a registration roller 85 is arranged on the upstream side of the transferring electrode 18, and the fixing device H is arranged on the downstream side of the separating electrode 20.

As show in FIG. 2, the fixing device H comprises a fixing roller pair 91 having a fixing roller 911 contacting the image forming surface of the paper and a pressure roller 912 which is rotated while contacting the fixing roller 911 by pressurizing and contacts the opposite surface of the image forming surface of the paper. In the fixing roller 911, a resin layer made of fluorocarbon resin or the like is formed on the surface of the body made of metal or the like, and a heat source 94 such as a halogen lamp heater or the like is disposed in the body. A separation pawl 93 is a member for separating the end of the paper P which is likely to twist around the outer periphery of the fixing roller 911. In the fixing roller 912, an elastic body layer made of silicon gum or the like is formed on the surface of the body made of metal or the like. The paper P on which a toner image on the photosensitive body 10 was transferred is conveyed upward, being sandwiched at a pressure contact portion of the fixing roller pair 91 to fix the toner image by heating and pressurizing, and is then conveyed further upward.

In FIG. 1, the storing portion F is a storing portion for paper feed trays 22 and 24 to store the papers P on which images are to be formed. When a movable plate S provided on the paper feed tray 24 moves up, the top paper contacts a later described delivery roller. The paper feed tray 22 also has a structure same as the above described structure. A space portion 25 having a predetermined clearance is formed between the bottom portion of the paper feed tray 24 arranged at the bottom and the bottom wall of the main body of the apparatus. The space portion 25 is a reverse path used in the case where images are formed on both sides of the paper P, and is used when reversing the side of the paper together with a reverse conveying path 86.

There are delivery rollers 50 and 53, feed rollers 51 and 54, and multi-feed preventing rollers 52 and 55 are provided at the tip portions of the feed trays 22 and 24 on the feeding direction side, respectively.

A bypass tray 60 can open and close around the lower end thereof as a supporting point with respect to the side wall of the main body of the image forming apparatus 1. The reference numeral 61 denotes a delivery roller to delivery the paper placed on the bypass tray 60, the reference numeral 63 denotes a feed roller provided on the downstream side of the delivery roller 61, the reference numeral 65 denotes a multi-feeding preventing roller which contacts the feed roller 63 by pressurizing and prevents to convey a plurality of papers P. They have a structure substantially same as that in the case of the above described paper feed trays 22 and 24.

Figure 3:
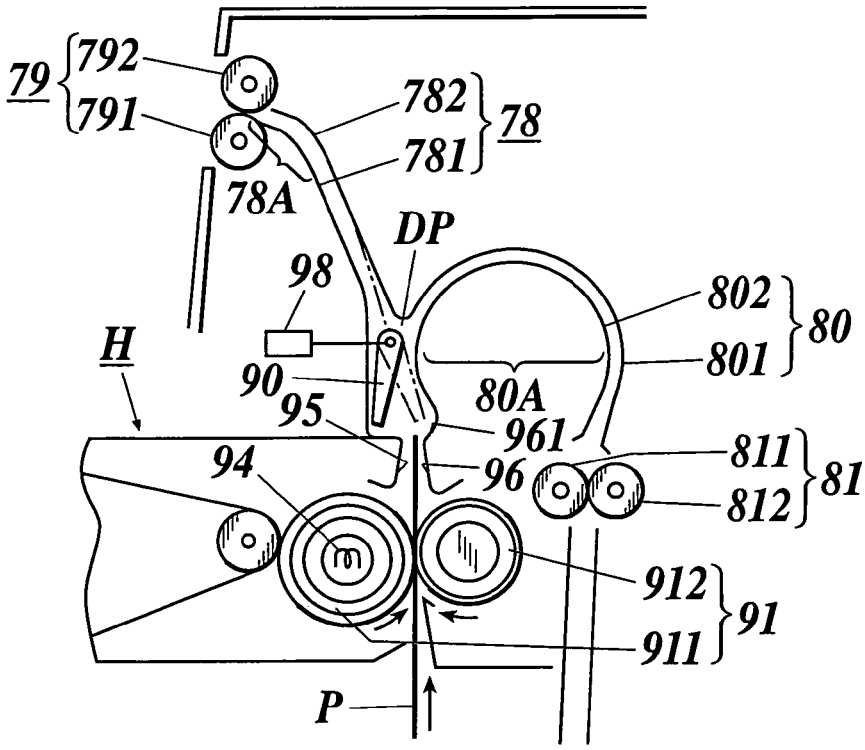
FIG. 3 is a partially sectional view of the image forming apparatus showing a structure of the embodiment in which a conveying path switching member 90 is used to curl a sheet according to the present invention.

Further in the present invention, as shown in FIG. 2, there are provided the first conveying path 78 to eject the paper P out of the apparatus, the second conveying path 80 to reverse and convey the paper P, and the conveying path switching member 90. As shown in FIG. 3, the first conveying path 78 and the second conveying path 80 comprise the first curved portion 78A and the second curved portion 80A, respectively. The first curved portion 78A and the second curved portion 80A curve in the opposite direction with each other. The conveying path switching member 90 switches from the first conveying path 78 to the second conveying path 80 or vice versa to guide the paper P on which an image was formed. Specifically, the conveying path is switched according to the setting by a user, that is, a one-side mode to form an image on one side of the paper or a both-side mode to form an image on both sides of the paper. For example, in the case where the both-side mode to form an image on both sides of the paper is set, the conveying path switching member 90 is switched to the position shown in the solid line in FIG. 2 to convey the paper P to the reverse feeding mechanism ADU, and the paper P is conveyed to the second conveying path 80. When the conveying path switching member 90 is switched to the position shown in the dotted line in FIG. 2, the paper P is conveyed to the first conveying path 78 and is ejected out of the apparatus by the eject roller pair 79 to be piled on an eject tray T.

The reverse feeding mechanism ADU is a mechanism for reversing the side of the paper, which comprises the second conveying path 80 having the second curved portion 80A, reverse conveying roller pairs 81, 82 and 83, and the like.

As shown in FIG. 2, the second conveying path 80 having the second curved portion 80A is formed with an outside inner wall 801 and an inside inner wall 802. The image forming side of the paper P contacts the outside inner wall 801, and the opposite side of the image forming side of the paper P contacts the inside inner wall 802. The second curved portion 80A curves to correspond to the conveying direction of the paper P. Thus, when the paper P is conveyed on the second conveying path 80, the paper P is curled corresponding to the curve of the second curved portion 80A.

The reverse conveying roller pair 81 formed with reverse conveying rollers 811 and 812 is arranged on the downstream side of the second conveying path 80 in the paper conveying direction. The reverse conveying roller pair 81 is formed with the reverse conveying rollers 811 and 812, and is arranged at the border between the end of the second conveying path 80 having the second curved portion 80A and the linear portion of the reverse conveying path 86. The length of the conveying path is set so that the paper P sandwiched by the fixing roller pair 91 is also sandwiched by the reverse conveying roller pair 81 at the same time. Further, the reverse conveying roller pair 82 comprising the reverse conveying rollers 821 and 822 is arranged on the downstream side of the reverse conveying roller pair 81 in the carrying direction. The length of the conveying path is set so that the paper P is sandwiched by the reverse conveying roller pairs 81 and 82 at the same time.

In FIG. 3, the first conveying path 78 having the first curved portion 78A is formed with an inside inner wall 781 and an outside inner wall 782, and an eject roller pair 79 comprising a pair of eject rollers 791 and 792 are arranged near the first curved portion 78A. The first curved portion 78A is curved to correspond to the conveying direction of the paper P. Thus, when the paper P is conveyed on the first conveying path 78, the paper P is curled corresponding to the curve of the first curved portion 78A.

Figure 4:
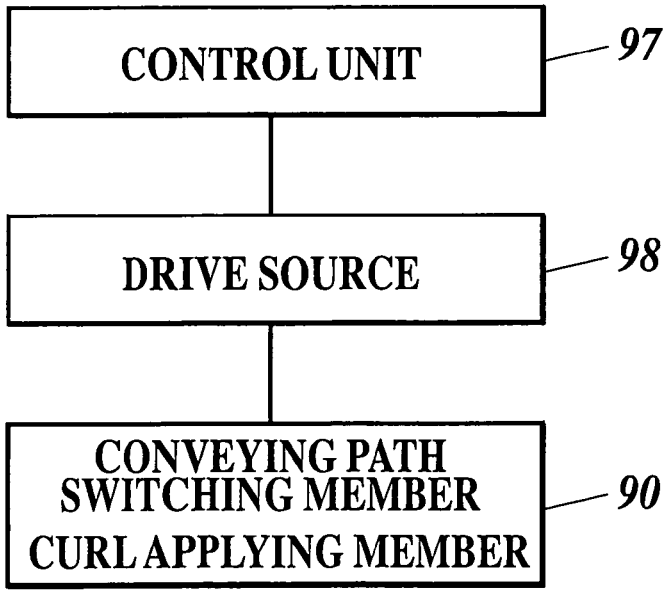
FIG. 4 is a block diagram showing a hardware structure of a control according to the embodiment of the present invention.

FIG. 4 is a block diagram showing a hardware structure of the control of the present invention. In FIG. 4, a control unit 97 controls the conveying path switching member 90 connected to a drive source 98 to switch the conveying path, and controls the operation of the conveying path switching member 90 as the curl applying member, by controlling the driving of the drive source 98. The control unit 97 preferably performs the control to make the curl applying member contact the paper which is being conveyed, so that the paper can be bent to be curled with the simple operation of making the curl applying member contact the paper. Thus, the paper can be previously curled by the simple method.

Figure 5A:
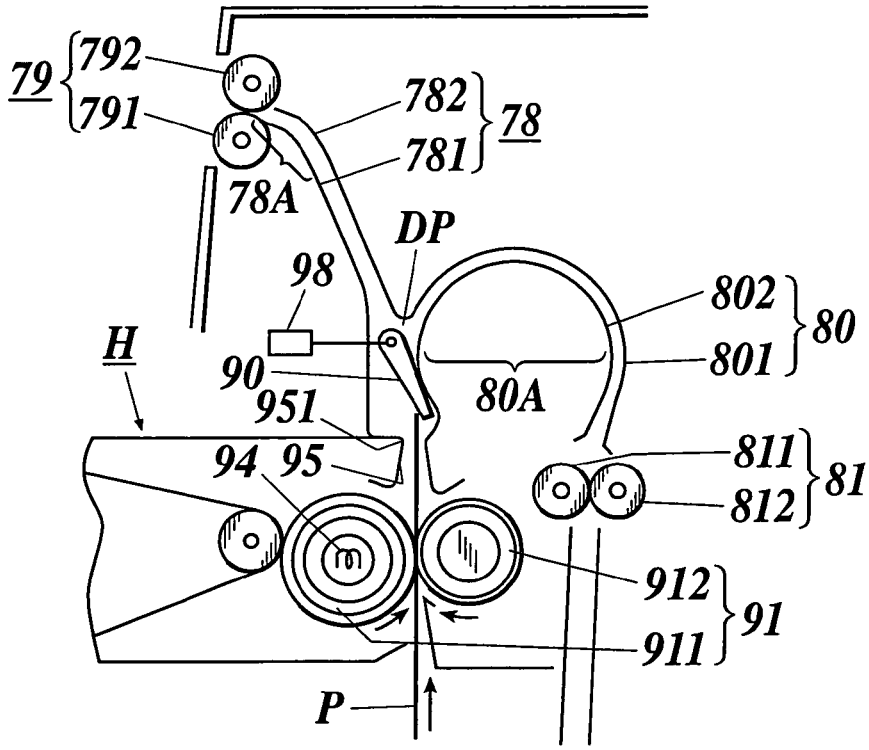
FIG. 5A is a partially sectional view showing a state where the conveying path switching member 90 is rotated counterclockwise and a paper P is going to be conveyed toward a first conveying path 78.
Figure 5B:
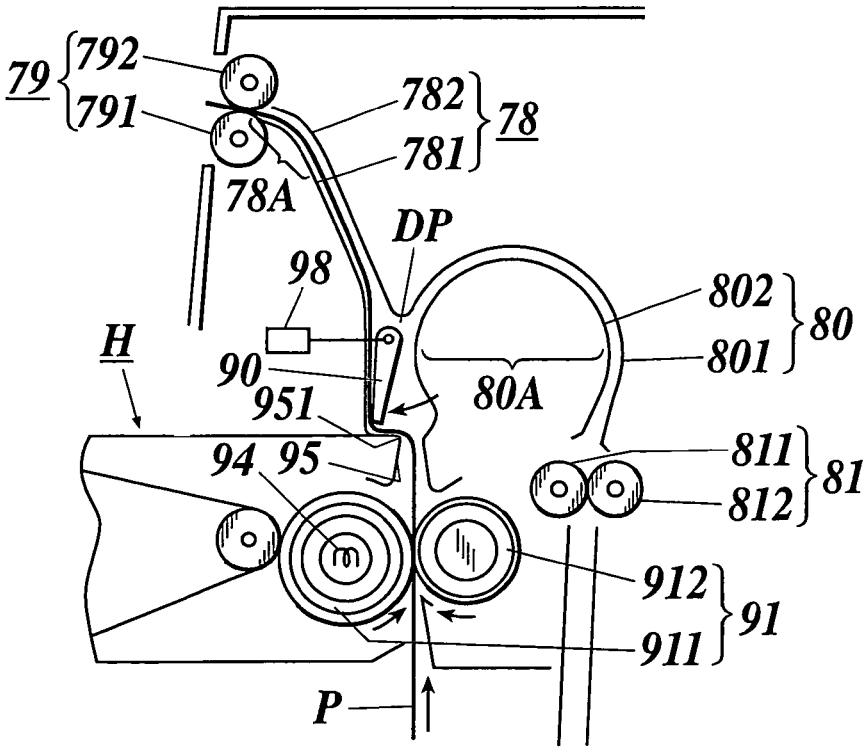
FIG. 5B is a partially sectional view showing a state where a tip of the conveying path switching member 90 contacts a back side of the paper P when a front end of the paper P reached an eject roller pair 79.
Figure 6A:
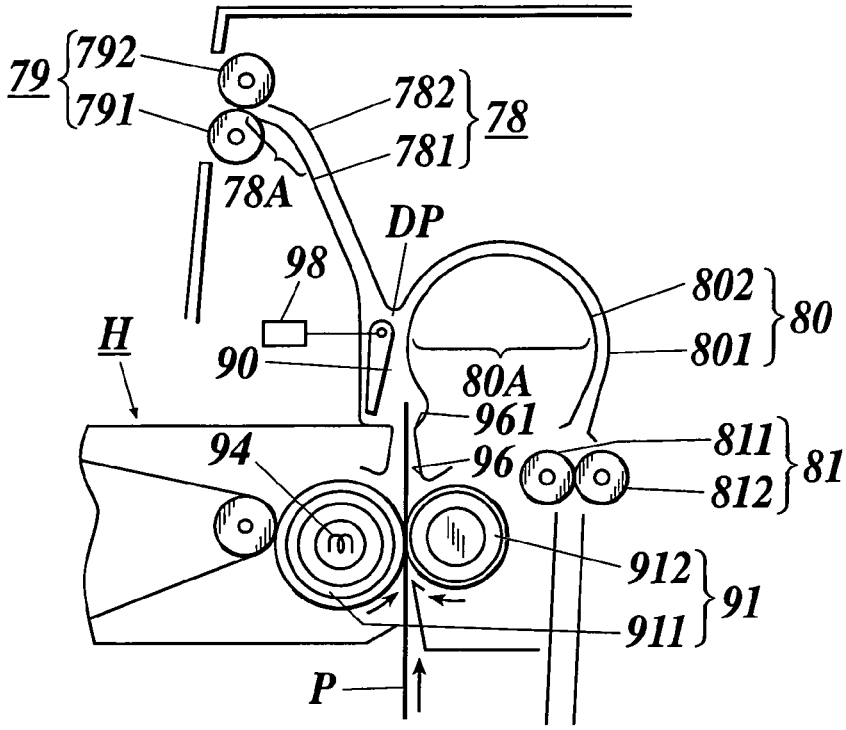
FIG. 6A is a partially sectional view showing a state where the conveying path switching member 90 is rotated clockwise and the paper P is going to be conveyed toward a second conveying path 80 having a second curving portion 80A.
Figure 6B:
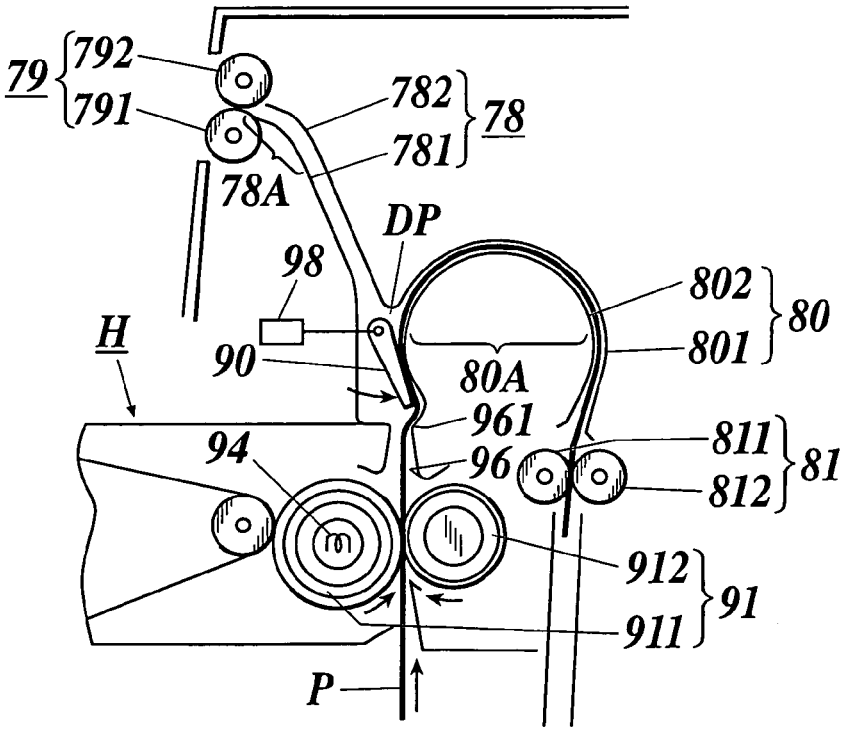
FIG. 6B is a partially sectional view showing a state where the tip of the conveying path switching member 90 contacts the back side of the paper P when the front end of the paper P reached a reverse conveying roller pair 81.

FIG. 3 is a partially sectional view of the image forming apparatus showing a structure of the embodiment to curl the paper by the curl applying member according to the present invention. In the present embodiment, the conveying path switching member 90 may double as the curl applying member. Thereby, there is no need to provide another curl applying member with a special mechanism, so that the paper can be easily curled beforehand at low cost. FIGS. 5A and 5B are partially sectional views for explaining the operation of the conveying path switching member 90 when the paper P is conveyed to the first conveying path 78 having the first curved portion 78A according to the embodiment of the present invention, and FIGS. 6A and 6B are partially sectional views for explaining the operation of the conveying path switching member 90 when the paper P is conveyed to the second conveying path 80 having the second curved portion 80A according to the embodiment of the present invention.

In FIG. 3, a pair of guide members 95 and 96 to guide the paper P are arranged on the downstream side of the fixing roller pair 91 provided in the fixing device H in the paper conveying direction, to face the conveying path switching member 90 as the curl applying member. Corner portions 951 and 961 each formed into a curved surface are provided at the most downstream portion of the guide members 95 and 96 in the paper conveying direction, respectively. The conveying path switching member 90 as the curl applying member and the guide member 95 form a bent conveying path. The bent conveying path to apply curl is formed by using the pair of guide members to guide the conveying of the paper and the curl applying member, so that the paper can be easily curled beforehand without providing a special constructional element. The corner portions 951 and 961 are preferably made of material with low friction such as tetrafluoroethylene, polyacetal or the like, or may be made of normal material with material with low friction coated thereon. The bending direction of the bent conveying path is a direction opposite to the curving direction of the first curved portion 78A on the downstream in the paper conveying direction. Also, the bent conveying path is formed with the conveying path switching member 90 as the curl applying member and the guide member 96, and the bending direction of this bent conveying path is a direction opposite to the curving direction of the second curved portion 80A on the downstream in the paper conveying direction. By forming the bent conveying path for applying curl by making the conveying path switching member 90 as the curl applying member contact the paper, the paper can be easily curled beforehand without providing a special constructional element. The bending direction of each bent conveying path is preferably a direction opposite to the curving direction of the first curved portion or the second curved portion, so that the paper to be conveyed can be curled in the curving direction corresponding to each of the plurality of curved conveying paths. Thus, the curl of the paper can be removed in any case of conveying the paper in the first conveying path and the second conveying path.

The conveying path switching member 90 is swingably arranged near the diverging point DP of the first conveying path 78 having the first curved portion 78A and the second conveying path 80 having the second curved portion 80A. The diverging point DP is at the downstream of the fixing device H in the paper conveying direction. The paper P slides on the tip portion of the conveying path switching member 90 as the curl applying member while contacting it, so that it is preferably made of material with low friction same as the corner portions 951 and 961, and formed into a curved surface.

The paper P on which the toner image was formed by the image forming portion E contacts the fixing roller pair 91 of the fixing device H by pressurizing to be fixed, and passes between the conveying path switching member 90 and the guide member 95 or 96 to be conveyed to the diverging point DP. The conveying path switching member 90 is connected to the drive source 98 composed of a solenoid or the like. The drive source 98 is driven by the instruction from the control unit 97, and the conveying path switching member 90 is rotated in clockwise or counterclockwise.

FIG. 5A is a view showing a state where the conveying path switching member 90 is rotated counterclockwise, and the paper P is going to be conveyed toward the first conveying path 78. FIG. 5B is a view showing a state where the tip of the conveying path switching member 90 contacts the back side of the paper P when the front end of the paper P reached the eject roller pair 79.

FIG. 6A is a view showing a state where the conveying path switching member 90 is rotated clockwise, and the paper P is going to be conveyed toward the second conveying path 80 having the second curving portion 80A. FIG. 6B is a view showing a state where the tip of the conveying path switching member 90 contacts the front side of the paper P when the front end of the paper P reached reverse conveying roller pair 81.

In FIG. 5A, the conveying path switching member 90 is rotated counterclockwise by the drive source 98 driven by the instruction from the control unit 97, and the paper P conveyed toward the diverging point DP from the fixing device H passes the left side of the conveying path switching member 90 to be conveyed to the first conveying path 78.

In the present invention, the first conveying path 78 is provided with the eject roller pair 79 as the first conveying roller, and the second conveying path 80 is provided with the reverse conveying roller pair 81 as the second conveying roller. Preferably, the control unit 97 performs the control to make the conveying path switching member 90 as the curl applying member contact the paper at the timing after the front end of the paper was sandwiched by the first conveying roller or the second conveying roller. Thus, by making the paper contact the curl applying member at the timing after the front end of the paper was sandwiched by the first conveying roller or the second conveying roller provided at the first conveying path 78 or the second conveying path 80, it is possible to prevent deterioration of the conveying property or the jamming of the paper which is caused when the paper is not sandwiched by the first conveying roller or the second conveying roller, thus enabling to apply the curl to the paper beforehand.

In FIG. 5B, the conveying path switching member 90 as the curl applying member is rotated clockwise shown by the arrow by the drive source 98 driven by the instruction from the control unit 97 at the timing after the front end of the paper P which passed the first conveying path 78 was sandwiched by the eject roller pair 79, and the tip of the conveying path switching member 90 as the curl applying member contacts the back side of the paper P. When the front end of the paper P was sandwiched by the eject roller pair 79, the paper P is still sandwiched by the fixing roller pair 91. When the tip portion of the conveying path switching member 90 as the curl applying member contacts the back side of the paper P, the front side of the paper P contacts the inside inner wall 781 of the first conveying path 78 and the guide member 95 to be conveyed on the bent conveying path formed with the first conveying path 78 and the guide member 95 to the downstream side in the paper conveying direction. At this time, the force acts in a direction to make the middle portion of the paper P convex with respect to the front and rear ends of the paper P in the paper conveying direction, when seeing the paper P from the front side. Thereby, a convex curl is previously applied to the paper P. Thereafter, the paper P is conveyed to the curved first conveying path 78, and by the curve of the first curved portion 78A, the force acts to apply a concave curl corresponding to the curving direction to make the middle portion of the paper P concave with respect to the front and rear ends of the paper P in the paper conveying direction. By the force acting in the direction to apply the concave curl, the previously applied convex curl is compensated and the curl of the paper can be removed.

In FIG. 6A, the conveying path switching member 90 is rotated clockwise by the drive source 98 driven by the instruction from the control unit 97, and the paper P conveyed toward the diverging point DP from the fixing device H passes the right side of the conveying path switching member 90 to be conveyed to the second conveying path 80 having the second curved portion 80A.

Thereafter, as shown in FIG. 6B, when the front end of the paper P which passed the second conveying path 80 having the second curved portion 80A was sandwiched by the reverse conveying roller pair 81, the conveying path switching member 90 as the curl applying member is rotated counterclockwise shown by the arrow by the drive source 98 driven by the instruction from the control unit 97, and the tip portion of the conveying path switching member 90 as the curl applying member contacts the front side of the paper. When the front end of the paper P is sandwiched by the reverse conveying roller pair 81, the paper P is still sandwiched by the fixing roller pair 91. When the tip portion of the conveying path switching member 90 as the curl applying member contacts the front side of the paper P, the back side of the paper P contacts the inside inner wall 802 of the reverse conveying roller pair 81 and the guide member 96 to be conveyed on the bent conveying path formed with the reverse conveying roller pair 81 and the guide member 96 to the downstream side in the paper conveying direction. At this time, the force acts in a direction to apply the concave curl to the paper P when seeing the paper P from the front side, so that the concave curl is previously applied to the paper P. Thereafter, the paper P is conveyed to the curved second conveying path 80, and the force acts in a direction to apply the convex curl corresponding to the curving direction of the second curved portion 80A. By the force acting in the direction to apply the convex curl, the previously applied concave curl is compensated and the curl of the paper can be removed.

As described above, the first curved portion 78A and the second curved portion 80A are curved portions which curve in the opposite direction with each other in the paper conveying direction. The curl applying member is provided on the downstream side of the fixing device and on the upstream side of the first curved portion 78A and the second curved portion 80A, in the paper conveying direction, and the control unit 97 controls the driving of the curl applying member. Thus, the curl in the opposite direction of the direction of the curl which is generated in the curved conveying path is previously applied, so that the curl generated in the curved conveying path and the previously applied curl are compensated each other. Therefore, the curl can be removed, and stably conveying the paper can be achieved.

Moreover, in the present invention, a paper conveying method of the image forming apparatus is provided by the above described structure.

That is, in the paper conveying method of the image forming apparatus in which a transferred toner image is formed on the paper at the image forming portion, the paper on which the transferred toner image was formed is fixed by heating, and the paper after fixing is conveyed to the conveying path having the curved portion, the curl curving in the opposite direction with respect to the curving direction of the curved portion is applied at the upstream side of the curved portion in the paper conveying direction to previously apply the curl in the direction opposite to the direction of the curl which is generated in the curved conveying path, so that the curl generated in the curved conveying path and the previously applied curl are compensated each other. Therefore, the curl can be removed, and stably conveying the paper can be achieved.

Preferably, the curl is applied by forming the bent conveying path. By forming the bent conveying path for applying the curl to the paper, the curl can be previously applied to the paper easily.

Further, preferably, the conveying path switching member 90, which is provided on the downstream side of the fixing device in the paper conveying direction and switches the conveying direction of the paper P, doubles as the curl applying member, and the curl is applied by making the conveying path switching member 90 contact the paper. By applying the curl with the use of the conveying path switching member 90, there is no need to provide a special mechanism, so that the paper can be previously curled with a simple method.

The conveying path having the curved portion is the first conveying path 78 having the first curved portion and the second conveying path 80 having the second curved portion. Preferably, the first curved portion and the second curved portion curve in the opposite direction with each other in the paper conveying direction. Thus, the paper can be previously curled in the curving direction corresponding to each of the plurality of curved conveying paths. Therefore, the curl of the paper can be removed in any case of conveying the paper in the first conveying path 78 and the second conveying path 80.

As a method to control the amount of the curl applied, the moving distance of the conveying path switching member 90 may be changed, or the structure may be such that a spring member to change the contact force of the conveying path switching member 90 to the paper P is used.

The entire disclosure of Japanese Patent Application Nos. Tokugan 2004-268048 which was filed on Sep. 15, 2004, and Tokugan 2005-68593 which was filed on Mar. 11, 2005, including specification, claims, drawings and summary are incorporated herein by reference in its entirety.

What is claimed is:

1. An image forming apparatus comprising:

an image forming portion to form a transferred toner image on a sheet;

a fixing device to fix the formed transferred toner image to the sheet by heating;

a conveying path switching member to switch a conveying direction of the sheet, the conveying path switching member being provided on a downstream side of the fixing device in a sheet conveying direction;

a pair of guide members adjacent the conveying path switching member and the pair of guide members upstream of a pivot point of the conveying path switching member;

a first conveying path having a first curved portion to eject the sheet out of the image forming apparatus, the first conveying path being provided on a downstream side of the conveying path switching member in the sheet conveying direction;

a second conveying path having a second curved portion to reverse and convey the sheet, the second conveying path being provided on a downstream side of the conveying path switching member in the sheet conveying direction; and a control unit to control a driving of the conveying path switching member, wherein the first curved portion and the second curved portion are curved in an opposite direction to each other with respect to the sheet conveying direction, the conveying path switching member is provided on an upstream side of the first curved portion and the second curved portion in the sheet conveying direction, and the control unit controls driving of the conveying path switching member to switch a position of the conveying path switching member during conveying the sheet, to form a bent conveying path by the conveying path switching member and one of the pair of guide members and to apply a curl to the sheet by making the one of the pair of guide members contact the sheet.

2. The image forming apparatus of claim 1, wherein a bending direction of the bent conveying path formed by the conveying path switching member and the one of the pair of guide members is an opposite direction to a curving direction of the first curved portion or the second curved portion.

3. The image forming apparatus of claim 1, wherein the first conveying path is provided with a first conveying roller, the second conveying path is provided with a second conveying roller, and the control unit performs a control to make the conveying path switching member contact the sheet by switching a position of the conveying path switching member at the timing after the end of the sheet was sandwiched by the first conveying roller or the second conveying roller.

4. The image forming apparatus of claim 1 wherein the control unit controls driving of the conveying path switching member to switch a position of the conveying path switching member during conveying the sheet, to form a first bent conveying path by the conveying path switching member and one of the pair of guide members and to apply a curl to the sheet by making the one of the pair of guide members contact the sheet, and to form a second bent conveying path by the conveying path switching member and the other of the pair of guide members and to apply a curl to the sheet by making the other of the one of the pair of guide members contact the sheet.

* * * * *